United States Patent [19]

Rushing et al.

[11] 3,954,128

[45] May 4, 1976

[54] SLING PURSE

[76] Inventors: James L. Rushing; Linda S. Rushing, both of 3012 NW. 43rd St., Oklahoma City, Okla. 73112

[22] Filed: Dec. 6, 1974

[21] Appl. No.: 530,217

[52] U.S. Cl. ..... 150/30; 150/33; 150/42

[51] Int. Cl.[2] ..... A45C 3/06

[58] Field of Search ..... 150/7, 11, 30, 33, 42, 150/46; 224/5 Q, 26 R

[56] References Cited

UNITED STATES PATENTS

| | | | |
|---|---|---|---|
| 380,416 | 4/1888 | Ames | 150/33 |
| 2,244,858 | 6/1941 | Stember | 150/33 |
| 3,425,470 | 2/1969 | Wuest | 150/30 |

FOREIGN PATENTS OR APPLICATIONS

| | | | |
|---|---|---|---|
| 636,169 | 1/1928 | France | 150/33 |

*Primary Examiner*—Donald F. Norton
*Attorney, Agent, or Firm*—Laney, Dougherty, Hessin & Fish

[57] ABSTRACT

A sling purse, including a flexible, open-topped main bag, having a bottom panel, back and front panels, and two side panels extending between and joining the back and front panels. Flexible, open-topped pockets are secured to the front and back panels, and each includes a facing panel extending substantially parallel to the respective back or front panel of the main bag to which the respective pocket is secured. The facing panels terminate at an upper edge which is in substantial alignment with the open top of the main bag. A flexible cover flap is secured to, or formed integrally with, the back panel and is dimensioned to extend across and cover the open top of the main bag. A flexible, elongated sling which includes two bight portions at opposite ends thereof, is positioned so that one bight portion extends through holes formed in the front, back and one side panel of the main bag, and through the facing panels of the pockets, and the other bight portion extends through other and additional holes formed in the front, back and one side panel of the main bag, and through the facing panels of the pockets, whereby, when the sling is tensioned, the open top of the main bag will be drawn closed, the cover flap will be drawn down across the closed top of the main bag, and the open-topped pockets will be closed.

2 Claims, 4 Drawing Figures

SLING PURSE

BACKGROUND OF THE INVENTION

1. Field of the Invention

This invention relates to bags and purses, and more particularly, to bags and purses which are closed by the action of the suspension of such bag or purse from a flexible handle or sling when such handle or sling in placed in tension.

2. Brief Description of the Prior Art

Purses and bags which close by tensioning a draw string used to carry the purse or bag have long been known. A variety of such bags or purses have been advocated or marketed, and various types of materials and articles have been carried therein. For many years, a well-known bag of this type was a small cloth bag provided by a leading tobacco company for the purpose of containing tobacco to be used in rolling cigarettes. Marbles, as well as other articles, have also been contained in bags of this general construction.

BRIEF DESCRIPTION OF THE PRESENT INVENTION

The present invention provides a novel, highly useful and very aesthetic sling purse or bag, which, in a preferred form, is useful as a shoulder purse, and which is closed as a result of the tension applied to a sling which is extended through the upper portion of the purse. The closing action is such that a cover flap is automatically closed over the open top of the purse, and pockets provided on the purse are closed, as well as a main bag forming the central portion of the purse.

Broadly described, the sling purse of the invention includes a flexible, open-topped main bag having a bottom panel, front and back panels, and two side panels extending between and joining the front and back panels. At least one flexible, open-topped pocket is secured to the back or front panel of the open-topped main bag, and includes a facing panel which extends substantially parallel to the respective back or front panel of the main bag to which the respective pocket is secured. The facing panel terminates at an upper edge which is in substantial alignment with the open top of the main bag. A flexible cover flap is secured to, or formed integrally with, the back panel of the main bag. The flexible cover flap is dimensioned to extend across and cover the open top of the main bag. A flexible, elongated sling is provided for suspending and carrying the purse, and such sling includes bight portions at opposite ends thereof. One of the bight portions extends through holes formed in the front panel, back panel and one of the side panels of the main bag, and also, through the facing panel of each pocket. The other bight portion extends through additional holes spaced from those through which the first bight portion extends, such additional holes being formed through the front panel, back panel, and the other of the side panels of the main bag, and through the facing panel of each pocket.

In a preferred embodiment of the invention, the flexible, elongated sling is a loop which has a central portion thereof between the described bight portions joined together and enclosed by a shoulder strap sleeve.

An important object of the invention is to provide an aesthetic, highly utilitarian sling purse which is constructed so that tensioning of the sling used to carry the purse will draw together, in an aesthetic, un-bunched fashion, the upper edges of the purse which define an opening into the main bag thereof and one or more pockets secured to the main bag.

An additional object of the invention is to provide a purse which is closed by means of the tension applied to a sling used to carry the purse, such closing affording a high degree of security against unauthorized access to the interior of the purse as it is being carried.

Additional objects and advantages of the invention will become apparent as the following detailed description of a preferred embodiment of the invention is read in conjunction with the accompanying drawings which illustrate such preferred embodiment of the invention.

DETAILED DESCRIPTION OF THE PREFERRED EMBODIMENT OF THE INVENTION

Figure 1:
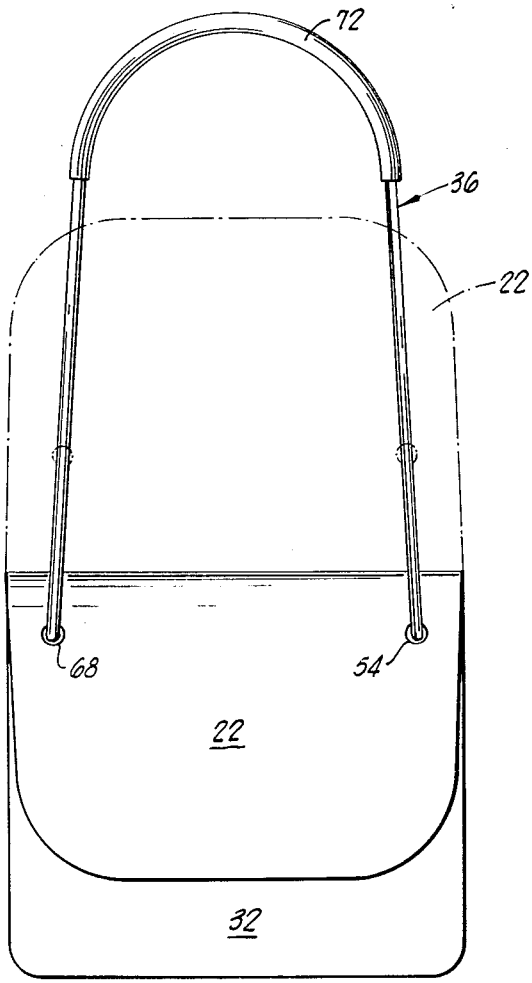
FIG. 1 is a front elevation view of the sling purse of the invention, showing in dashed lines the appearance of the cover flap, when the cover slap is opened to permit access to the interior of the purse.
Figure 2:
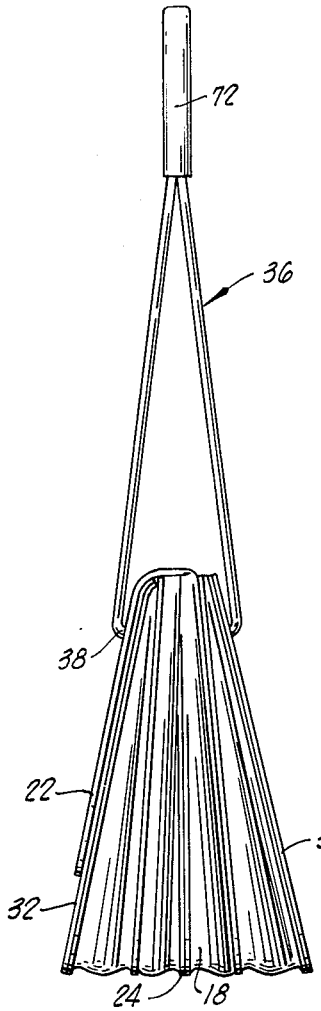
FIG. 2 is an end elevation view of the sling purse of the invention as shown in FIG. 1.

The sling purse of the invention includes a main bag designated generally by reference number 10, which main bag includes a bottom panel 12, a front panel 14 and a back panel 16. The front and back panels of the sling purse are joined by two side panels 18 and 20. The main bag is constructed of a flexible material, such as natural or composition leather, or a synthetic resin, and is formed with an open top. Secured to the top edge of the back panel 16 is a flexible cover flap 22, which cover flap, in a preferred embodiment of the invention, is formed integrally with the back panel 16.

In a preferred construction of the sling purse of the invention, the bottom panel 12, front panel 14, back panel 16, side panels 18 and 20 and cover flap 22 are all integrally formed and developed from a single, unitary blank of natural leather. The natural leather blank is cut from a cured leather skin so that the flap portion 22 is that portion of the hide which was located nearest the backbone of the animal and therefore, is characterized by the greatest mechanical strength and resistance to stretch. When the blank is folded, the two side panels 18 and 20 are formed from turned over portions extending from the front and back panels 14 and 16, with these turned over portions secured along a seam or sew lines 24 and 26 as illustrated in the drawings. There are thus no seams located at stress areas and ease of manufacture is facilitated.

The sling purse of the invention further includes at least one open-topped pocket secured to the outer side of either the front or the back panels 14 or 16, or both of these panels. Two of such open-topped pockets are illustrated in the drawings, and are designated generally by reference numerals 28 and 30. Each of the pockets 28 and 30 which are provided in the particular embodiment of the invention illustrated includes a facing panel 32 which extends substantially parallel to the respective back or front panel of the main bag to which the respective pocket is secured. Each of the open-topped pockets 28 and 30 further includes a web panel 34 which is located between, and interconnects, the facing panel 32 of the respective open-topped pocket and its respective back or front panel of the main bag upon which it is located. The web panel and facing panels used in the construction of the open-topped pockets 28 and 30 are, like the main bag, constructed of a flexible material. The facing panels 32 of each of the open-topped pockets 28 and 30 is characterized in having an upper edge 32*a* which extends substantially parallel to the upper edges of the front and back panels 14 and 16 of the main bag 10, and is at substantially the same vertical level on the sling purse as the upper edges of the front, back and side panels of the open-topped main bag.

For the purpose of carrying the sling purse, and of drawing it closed when the purse is carried, an elongated flexible sling, designated generally by reference character 36, is provided. The elongated flexible sling 36 includes a pair of bight portions 38 and 40 disposed at opposite ends of the sling and extended through holes formed through the several panels making up the main bag, and making up the flexible cover flap and the facing panels of the open-topped pockets. Thus, the bight portion 38 of the sling 36 extends through horizontally aligned holes 42 and 44 in the back panel 16 and front panel 14, respectively, of the main bag. The bight portion 38 also extends through a pair of horizontally spaced holes 46 and 48 formed through the side panel 18 at locations on opposite sides of the seam 24 formed therein.

Figure 3:
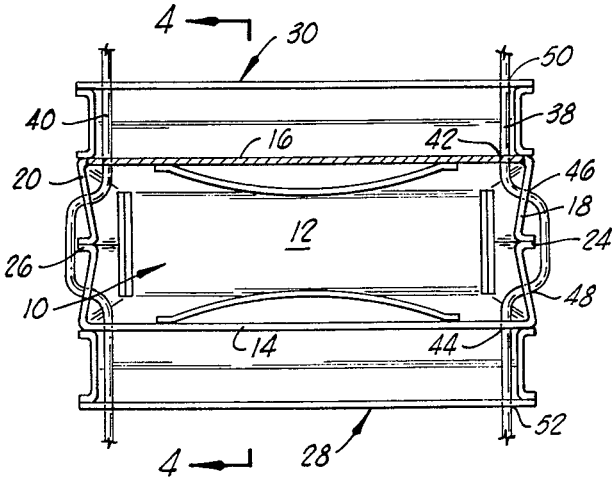
FIG. 3 is a top plan view of the purse in its opened status, with the flexible cover flap and a portion of the sling, cutaway for clarity of illustration.
Figure 4:
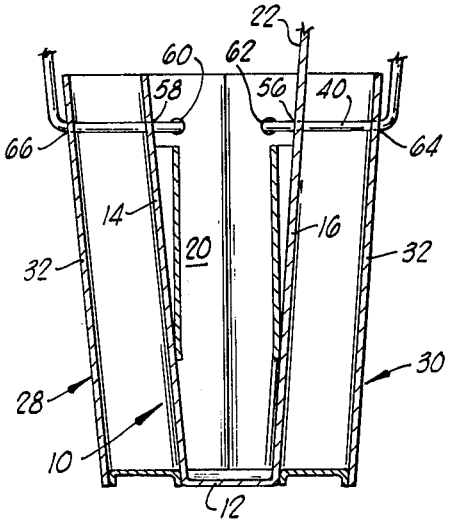
FIG. 4 is a vertical cross-sectional view taken through the purse along line 3—3 of FIG. 3 when the purse is in its opened position.

It will be noted, in referring to FIG. 3, that the bight portion 38 extends across the seam 24 on the outer side of the main bag 10. The bight portion 38 also extends through holes 50 and 52 formed in horizontal alignment through the facing panels 32 of the open-topped pockets 28 and 30. These holes are superimposed over, and aligned with, the holes 42 and 44 in the front and back panels. Finally, the bight portions 38 is extended through a hole 54 formed through the flexible cover flap 22 at a location spaced from its line of joinder with the back panel 16, and spaced inwardly a short distance from the side edge of the flexible cover flap. The hole 54 in one side of the flexible cover flap is positioned so that, when the elongated sling 36 is placed in tension to close the main bag 10 and open-topped pockets 28 and 30 in the manner hereinafter described, the hole 54 is placed in alignment with the other holes which accommodate the bight portion 38.

For the purpose of accommodating the bight portion 40 at the other end of the elongated sling 36, a plurality of holes 56–68 are formed through the various panels of the purse and the cover flap 22 in the manner heretofore described. The holes 56–64 are spaced horizontally from the holes 42–54 and are positioned for alignment upon closure as hereinafter described.

In a preferred embodiment of the invention, the elongated, flexible sling 36 is formed as a continuous loop or ring, and includes a central portion which is enclosed within a protective, load bearing sleeve 72. The load bearing sleeve 72 has a flat underside which is adapted to pass comfortably over and bear against, the shoulder of one carrying the sling purse.

In the operation and use of the sling purse, the tension applied to the bight portions 38 and 40 may be relieved by setting the purse on a surface. With the relief of the tension in the bight portions 38 and 40, the main bag may be opened by pulling apart the front panel 14 and back panel 16. This provides access to the interior of the main bag 10 through the relatively large opening at the top thereof. The open-topped pockets 28 and 30 can also be opened when the tension in the bight portions 38 and 40 is relieved in the manner described. When the bag is to be carried, it is suspended from the elongated sling which may be grasped with the hand, or passed over the shoulder, utilizing the sleeve 72.

When the bag is thus carried, the weight of the contents of the bag causes the elongated sling 36 to be placed in tension. The tensioning of the sling 36 causes the bight portions 38 and 40 located at the opposite ends thereof to be placed in tension with the result that the back panel 16 is drawn toward the front panel 14 of the main bag 10, and the open top of the main bag is thus securely closed. The tensioning of the bight portions 38 and 40 also results in the closure of the open-topped pockets 28 and 30 and prevents access to the interior of these pockets. Further, the particular location of the holes 54 and 68 formed through the flexible cover flap 22 is such that when the flexible sling 36 is placed in tension, the cover flap will be caused to extend closely over, and securely close, the open top of the main bag 10, as well as the open-topped pocket 28 secured to the front panel 14 of the main bag. Such closure is effected without detracting from the aesthetics of the purse due to unsightly wrinkling or bunching. This is particularly due to the positioning of the holes which receive the bight portions of the sling, and the manner in which the flexible cover flap 22 cooperates with the bight portions 38 and 40 of the sling when they are placed in tension.

Although a preferred embodiment of the invention has been herein illustrated and described, it will be understood that changes and innovations can be made in the illustrated and described embodiment of the invention without departure from the basic principles which underlie the invention. Changes and innovations of this type are therefore deemed to be cicumscribed by the spirit and scope of the invention except as the same may be necessarily limited by the appended claims or reasonable equivalents thereof.

What is claimed is:

1. A sling purse comprising:

a flexible, open-topped main bag having a bottom panel, back and front panels, and two side panels extending between and joining the back and front panels;

at last one flexible, open-topped pocket secured to one of said back and front panels outside of said main bag and including a facing panel extending substantially parallel to the respective back or front panel to which it is secured, said facing panel having an upper edge terminating at a level even with the upper edges of said back and front panels;

a flexible cover flap secured to the back panel and dimensioned to extend across and cover the open top of the main bag, said main bag and flexible cover flap constituted by a single, unitary piece of leather and said cover flap being stronger and less stretchable than said front, back and side panels; and an elongated, flexible sling which includes two bight portions at opposite ends thereof, one of said bight portions extending through holes in said front panel, said back panel, one of said side panels, said facing panel of said pocket, and through a hole in said cover flap, and the other of said bight portions being spaced across the top of said main bag from said first-mentioned bight portion and extending through holes in said front panel, said back panel, the second of said side panels, said facing panel and said cover flap, whereby tensioning of said bight portions will draw the upper edges of said front, back and facing panels into juxtaposition with each other, and will close said cover flap over the upper edge of said front panel.

2. A sling purse comprising:

a flxible, open-topped main bag, having a bottom panel, back and front panels, and two side panels extending between and joining the back and front panels, said bottom panel extending between the lower edges of said back and front panels and spacing said back and front panels from each other;

at least one flexible, open-topped pocket including:

a facing panel having an upper edge terminating at a level even with the upper edges of said back and front panels; and a flexible web panel extending between and interconnecting said facing panel and one of said back or front panels to retain said facing panel in a position in which it extends substantially parallel to the respective back or front panel to which it is secured;

a flexible cover flap integrally formed with said back panel and dimensioned to extend across and cover the open top of said main bag and project downwardly along and parallel to one of said back or front panels of said main bag when said bag is closed; and an elongated, flexible sling which includes two bight portions at opposite ends thereof, one of said bight portions extending through a hole in said front panel, a hole in said back panel, a hole in said facing panel of said pocket, a hole in said cover flap spaced from the hole in the back panel through which said bight extends and spaced from a fold line of joinder between said back panel and said flexible cover flap, and through two holes in one of said side panels, which two holes are horizontally spaced from each other when said bag is opened and stands upright by resting it on said bottom panel, and the other of said bight portions being spaced across the top of said main bag from said first mentioned bight portion and extending through a hole in said front panel, a hole in said back panel, a hole in said facing panel, a hole in said cover flap spaced from the hole in said back panel through which said other bight portion extends and spaced from a fold line where said flexible cover flap joins said back panel, and through two horizontally spaced holes in the other of said side panels, the spaced pairs of holes in the two side panels being disposed, in relation to said two bight portions, whereby, when each of the respective bight portions is tensioned, each of the respective side panels is folded about a vertical fold line between the two horizontally spaced holes formed therein and receiving the respective bight portion, and is collapsed inwardly between said front and back panels, said inward collapsing of the two side panels, cooperating with said bottom panel and the web panel to provide a generally pyramidal shape to the sling purse when it is collapsed into its closed position.

* * * * *